US009315994B2

(12) United States Patent
Chen

(10) Patent No.: US 9,315,994 B2
(45) **Date of Patent: *Apr. 19, 2016**

(54) METHODS AND SYSTEMS FOR DECORATING BEVEL AND OTHER SURFACES OF LAMINATED FLOORINGS

(71) Applicant: Mannington Mills, Inc., Salem, NJ (US)

(72) Inventor: Hao A. Chen, Salem, NJ (US)

(73) Assignee: Mannington Mills, Inc., Salem, NJ (US)

( * ) Notice: Subject to any disclaimer, the term of this patent is extended or adjusted under 35 U.S.C. 154(b) by 261 days.

This patent is subject to a terminal disclaimer.

(21) Appl. No.: 13/733,293

(22) Filed: Jan. 3, 2013

(65) Prior Publication Data

US 2013/0122255 A1 May 16, 2013

Related U.S. Application Data

(62) Division of application No. 13/033,222, filed on Feb. 23, 2011, now Pat. No. 8,365,488, which is a division of application No. 11/651,955, filed on Jan. 10, 2007, now Pat. No. 7,918,062.

(60) Provisional application No. 60/811,938, filed on Jun. 8, 2006.

(51) Int. Cl.

| | |
|---|---|
| ***E04C 2/30*** | (2006.01) |
| ***B41J 3/407*** | (2006.01) |
| ***B41M 5/00*** | (2006.01) |

(Continued)

(52) U.S. Cl.

CPC . *E04C 2/30* (2013.01); *B41J 2/005* (2013.01); *B41J 3/407* (2013.01); *B41M 5/0041* (2013.01); *E04F 15/02033* (2013.01); *B41M 3/00* (2013.01); *Y10T 428/24488* (2015.01);

(Continued)

(58) Field of Classification Search

USPC ..... 347/102; 52/311.1, 582.1

See application file for complete search history.

(56) References Cited

U.S. PATENT DOCUMENTS

| | | | |
|---|---|---|---|
| 6,006,486 | A | 12/1999 | Moriau et al. |
| 6,234,299 | B1 | 5/2001 | Voorhees et al. |

(Continued)

FOREIGN PATENT DOCUMENTS

| | | | |
|---|---|---|---|
| EP | 1 108 529 | A2 | 6/2001 |
| EP | 1 642 751 | A2 | 4/2006 |

(Continued)

OTHER PUBLICATIONS

Communication Relating to the Results of the Partial International Search for PCT/US2007/013499 dated Jan. 8, 2008.

(Continued)

*Primary Examiner* — Lamson Nguyen

(74) *Attorney, Agent, or Firm* — Kilyk & Bowersox, P.L.L.C.

(57) ABSTRACT

Methods and systems for decorating at least one bevel surface or other surface of a laminated flooring are described. The bevel surface can be decorated by non-transfer printing such as digital printing. The digital printer can be an ink jet printer such as a piezoelectric drop-on-demand (DOD) printer that allows a color and pattern to be placed on the bevel surface that matches the print design (décor pattern or face design) of the laminated flooring. Other devices are provided such as a device that takes a picture of or scans an image of the print design, and modifies the taken picture or the scanned image so that the edge pattern thereof matches with an edge pattern of the print design.

50 Claims, 2 Drawing Sheets

(51) Int. Cl.
*E04F 15/02* (2006.01)
*B41J 2/005* (2006.01)
*B41M 3/00* (2006.01)

(52) U.S. Cl.
CPC .. *Y10T428/24777* (2015.01); *Y10T 428/24802* (2015.01)

(56) References Cited

U.S. PATENT DOCUMENTS

| | | | | |
|---|---|---|---|---|
| 6,584,739 | B2 | 7/2003 | Zeif | |
| 6,585,369 | B1 | 7/2003 | Sievert et al. | |
| 6,617,009 | B1 | 9/2003 | Chen et al. | |
| 6,675,545 | B2 | 1/2004 | Chen et al. | |
| 6,761,008 | B2 | 7/2004 | Chen et al. | |
| 6,761,794 | B2 | 7/2004 | Mott et al. | |
| 6,786,019 | B2 | 9/2004 | Thiers | |
| 6,931,811 | B2 | 8/2005 | Thiers | |
| 6,933,043 | B1 | 8/2005 | Son et al. | |
| 6,986,934 | B2 | 1/2006 | Chen et al. | |
| 7,001,016 | B2 | 2/2006 | Baxter et al. | |
| 7,169,460 | B1 | 1/2007 | Chen et al. | |
| 7,249,445 | B2 | 7/2007 | Thiers | |
| 7,506,481 | B2 | 3/2009 | Grafenauer | |
| 7,632,561 | B2 | 12/2009 | Thiers | |
| 7,678,425 | B2 | 3/2010 | Oldorff | |
| 7,918,062 | B2 * | 4/2011 | Chen | 52/311.1 |
| 2001/0021431 | A1 | 9/2001 | Chen et al. | |
| 2002/0014047 | A1 | 2/2002 | Thiers | |
| 2002/0031646 | A1 | 3/2002 | Chen et al. | |
| 2002/0056245 | A1 | 5/2002 | Thiers | |
| 2002/0142135 | A1 | 10/2002 | Chen et al. | |
| 2003/0012933 | A1 | 1/2003 | Senzani | |
| 2003/0033777 | A1 | 2/2003 | Thiers et al. | |
| 2003/0159385 | A1 | 8/2003 | Thiers | |
| 2003/0203165 | A1 | 10/2003 | Nobles et al. | |
| 2003/0207083 | A1 | 11/2003 | Hansson et al. | |
| 2004/0076788 | A1 | 4/2004 | Steinhardt et al. | |
| 2004/0086678 | A1 | 5/2004 | Chen et al. | |
| 2004/0219339 | A1 | 11/2004 | Dempsey et al. | |
| 2004/0255541 | A1 | 12/2004 | Thiers et al. | |
| 2004/0264992 | A1 | 12/2004 | Shiraishi | |
| 2005/0016099 | A1 | 1/2005 | Thiers | |
| 2005/0025934 | A1 | 2/2005 | Thiers | |
| 2005/0069681 | A1 | 3/2005 | Wright, Jr. et al. | |
| 2005/0076598 | A1 | 4/2005 | Lewark | |
| 2005/0167027 | A1 | 8/2005 | Lane | |
| 2005/0235593 | A1 | 10/2005 | Hecht | |
| 2005/0248649 | A1 | 11/2005 | Farrell et al. | |
| 2005/0249923 | A1 | 11/2005 | Reichwein et al. | |
| 2005/0249924 | A1 | 11/2005 | Reichwein et al. | |
| 2006/0032175 | A1 | 2/2006 | Chen et al. | |
| 2006/0059821 | A1 | 3/2006 | Coghlan et al. | |
| 2006/0130421 | A1 | 6/2006 | Nollet et al. | |
| 2006/0156672 | A1 | 7/2006 | Laurent et al. | |
| 2006/0162271 | A1 | 7/2006 | Eisermann | |
| 2006/0179773 | A1 | 8/2006 | Pervan | |
| 2006/0179774 | A1 | 8/2006 | Thiers | |
| 2006/0179775 | A1 | 8/2006 | Thiers | |
| 2006/0179776 | A1 | 8/2006 | Thiers | |
| 2006/0234017 | A1 | 10/2006 | Tajima et al. | |
| 2007/0283648 | A1 | 12/2007 | Chen | |
| 2008/0034701 | A1 | 2/2008 | Pervan | |
| 2009/0031662 | A1 | 2/2009 | Chen et al. | |
| 2009/0038256 | A1 | 2/2009 | Thiers | |
| 2009/0075037 | A1 | 3/2009 | Garitano | |
| 2009/0159156 | A1 | 6/2009 | Walker | |
| 2009/0305008 | A1 | 12/2009 | Nichols et al. | |
| 2011/0219716 | A1 | 9/2011 | Chen | |
| 2012/0156432 | A1 * | 6/2012 | Gerbl | 428/151 |

FOREIGN PATENT DOCUMENTS

| | | | |
|---|---|---|---|
| JP | 2001-293838 | A | 10/2001 |
| JP | 2004-60241 | A | 2/2004 |
| WO | WO 2004/042168 | A1 | 5/2004 |
| WO | WO 2006/003530 | A2 | 1/2006 |
| WO | WO 2007/054812 | A2 | 5/2007 |

OTHER PUBLICATIONS

Notification of Transmittal of the International Search Report and the Written Opinion of the International Searching Authority, mailed Apr. 23, 2008, together with the International Search Report and Written Opinion of the International Searching Authority for corresponding International Patent Application No. PCT/US2007/013499.

* cited by examiner

METHODS AND SYSTEMS FOR DECORATING BEVEL AND OTHER SURFACES OF LAMINATED FLOORINGS

This application is a divisional of U.S. patent application Ser. No. 13/033,222, filed Feb. 23, 2011, which in turn is a divisional of U.S. patent application Ser. No. 11/651,955, filed Jan. 10, 2007, now U.S. Pat. No. 7,918,062 which in turn claims the benefit under 35 U.S.C. §119(e) of prior U.S. Provisional Patent Application No. 60/811,938, filed Jun. 8, 2006, which are incorporated in their entirety by reference herein.

FIELD OF THE INVENTION

The present invention in part relates to a product with a decorative surface having two different types of decorative materials adjacent to each other and that can be applied by different methods of applying the decoration, preferably wherein the decoration materials can not be visually discernable. One of the decorative materials can be a highly durable material that is used on the main surface of the flooring that withstands daily wear and tear from foot traffic and also resists gouging, abrasions, and scratches, and other damage from moving heavy objects. The other decorative material can be a less durable material that is applied, for instance, on recessed areas such as bevel edges, as well as the surfaces of tongue and groove joints that do not typically come into direct contact with the daily foot traffic. Decorative areas simulating grout, mortar, borders, and other depressed or indented areas can also benefit from the present invention. The less durable material can comprise a radiation curable ink system having superior adhesion and wear characteristics over the conventional thermo-foil film used on the bevel surface and/or other areas such as areas simulating grout, mortar and border, etc. The present invention also relates to methods and systems for providing the most economical and efficient ways of making laminated floorings with a decoration or a pattern on a bevel surface (and/or other surfaces) that comprises a non-transfer printing or a non-contact means of applying decoration onto the bevel surface (and/or other surfaces) and/or one or more surfaces of tongue and groove joints. Particularly, the present invention relates to digital printing on the bevel surface, and/or one or more surfaces of the tongue and groove joint, and/or one or more surfaces simulating grout, mortar, borders, or other depressed or indented areas of a pattern. The present invention further relates to methods and systems using ink jet printing apparatuses for printing on bevel surfaces, and/or one or more surfaces of the tongue and groove joint and/or one or more surfaces simulating grout, mortar, borders, or other depressed or indented areas of a pattern, of laminated floorings with colors and decorative patterns matching and lining up with those of the décor pattern or face design of laminated floorings.

BACKGROUND OF THE INVENTION

Planks (panels) or boards are employed in floorings. For example, planks are cut from a large laminated flooring board or substrate to make it easy for shipping and handling by installers and then the planks are later put together to cover a floor. Planks can be provided with multiple edges, and at least one of the edges can have a bevel surface that can be formed by cutting away one or more edges, as described in U.S. Pat. No. 6,786,019, which is incorporated herein in its entirety by reference. The edges can have a tongue and groove profile as well, for example as described in International Patent Publication No. WO 97/47934, which is incorporated herein in its entirety by reference. The edges and/or other parts of the floor plank can have one or more areas simulating grout, mortar, borders, or other depressed or indented areas of a pattern by embossing or by routing, or by cutting or any combination thereof. The top face of the laminated flooring can have a surface décor or a face pattern, for example, as described in U.S. Pat. No. 6,786,019.

Several methods of providing a decorative design onto the surface of a bevel edge have been used. These include emboss bevel by registration, thermo-foil transfer printing and vacuum coating and/or roll coating (pigmented coating).

In the emboss bevel by registration process, the same pattern covers the entire surface and edges of the laminated flooring. Only the edges are depressed to form into the bevel surfaces by the embossing plate that is aligned to the edges of the board during the pressing operation. The difficulty of this process is to precisely line up printed paper that carries the design, to the edges of the embossing plate as well as to cut the individual embossed bevel plank out of the whole pressed board. This process is typically done by a smaller press in a highly manual and intensive labor involved operation. Even with that, the process still produces a higher rate of off-goods due to poor registration during pressing and the rip-cutting operation. The manufacture cost of making bevel edges from this process is generally high.

In the more common thermo-foil transfer printing process, a pre-formed thermo-foil is used to transfer a pre-print design onto a bevel surface. The thermo-foil is prepared as a thin multi-layered film construction. The construction involves a Mylar carrier film (Mylar is a thin, strong polyester film that is typically used in packaging, insulation, recording tapes or photography), an easy release layer, a wear layer such as an acrylic layer, a gravure printed decorative layer (gravure is a printing process using multiple engraved cylinders to create a design), or a pre-printed paper, and a heat activated adhesive layer.

In the process of transfer printing by thermo-foil, the thermo-foil is passed between a heated silicone rubber roll and the surface of the bevel edge such that the thermo-foil is aligned. This allows the hot silicone rubber roll to contact the Mylar carrier side of the thermo-foil and the adhesive to contact the surface of the bevel edge. The decorative layer on the thermo-foil is then transferred to the surface of the bevel edge by means of appropriate temperature and pressure for an appropriate contact time by a heated pressing roll. The carrier film is then separated by pulling it from the product and rolling it up on a collection roll.

In such a process, a KURTZ KTF 70® machine, for example, can be used which typically operates at 240-270° C. on the silicone rubber belt and the line speed is about 50-60 meters per minute, resulting in a contact time of about 0.3 second. The amount of heat applied on the pressing roll, the dwelling time of pre-heating the bevel surface, the transfer of the decorative layer or pre-printed paper, and the pressure of the roll are factors that control the speed and image of the design being transferred.

The thermo-foil transfer printing on a bevel surface is complicated since it involves at least a three step process, which requires firstly forming the thermo-foil through a complicated gravure printing process and then secondly slitting the printed roll into multiple 7-8 mm wide coils; many small diameter coils are then spooled into a large diameter size coil for production used. Lastly, the coil is then transferring the pre-formed thermo-foil onto the bevel surface. During the gravure printing process, matching the color and pattern of a chosen sample is required which is also a daunting and time consuming step. This is usually accomplished through multiple trials and errors. Adding to the complexity is the long lead time and high cost associated with the gravure printing process. The steps involved are pre-press preparation; design proofing, and cylinders engraving etc. before running the printing operation.

Additionally, after matching the color and pattern, manufacturers typically need a large quantity of the thermo-foil in order to justify the efficiency of the operation and to lower the cost of making the end product. Therefore, the manufacturer typically carries a significant amount of inventory of the thermo-foil.

Another draw back of transfer printing thermo-foil onto bevel surfaces of laminated floorings is the waste factor, which can ultimately increase the cost of the manufacturing of the laminated floorings. The width of a pre-formed thermo-foil is usually 8-9.5 mm but the typical width of a bevel of laminated flooring that needs to be covered by the thermo-foil is 1.0 to 2.0 mm. The effective utilization of the thermo-foil is only 10-20% and the rest is wasted material. As a result, the waste of the thermo-foil in covering the bevel surface is extremely high.

There is yet another drawback in using transfer printing thermo-foil. The core of laminated flooring which at least in part forms the bevel surface can be made from different materials, such as very hard core materials. Certain hard core materials, such as high density fiberboard (HDF), can make the conventional printing processes of the bevel surface cumbersome and problematic. For example, after beveling a plank for the laminated flooring, the bevel surface may not be sufficiently smooth due to the rough surface caused by microfibers in a HDF or residual shaving dusts on the surface. This can significantly and negatively affect the adhesion of the thermo-foil on the bevel surface.

The biggest drawback in using transfer printing thermo-foil is that it is not applicable for decorating grout, mortar and border areas of a plank/tile which have the recessed areas away from the edge, such as in the middle of the panel and/or the recessed depth is relatively shallow in relationship with the non-recessed areas. It is very difficult to transfer the printing thermo-foil into the recessed areas with enough pressure for good adhesion and also to control the foil precisely going to the recessed areas without transferring onto the boundary of the flat, non-recessed surface of the panel.

In vacuum coating, a vacuum coating machine is used and the machine is based on a vacuum die. The vacuum die is constructed to have an identical shape of what is to be coated, so that it contours to the surface of the part to be coated. This is a significant limitation of the process in itself. A color coating liquid is fed through a port in the center of the die that floods the surface to be coated and decorated. Surrounding the die are orifices under vacuum to remove excessive colored coating liquids. A thin layer of coating results and covers the surface to be decorated.

The support system for vacuum coating that surrounds the die is a chamber that contains the color coating liquid and vacuum equipment in order to keep the die under vacuum. This system allows only low viscosity liquid coating to be applied. The typical viscosity of the liquid is 400 to 800 cps. The coating weight is 0.4 gram per foot for a particular tongue and groove joint system. The coating liquid is usually applied at 60 psi vacuum with 50% recycle supply and with a line speed of 70 fpm.

In roll coating, basic coating machines such as a 2 roll coater, differential roll coater, reverse roll coater etc. are usually used to apply a coating liquid on a surface of the bevel edge. A layer of a coating liquid metered by the coater machine is applied on the bevel surface. The viscosity of the coating for this application is typically higher; the thickness of the coating on the bevel surface is therefore thicker and tends to spread over the edges of the decorative surface. The appearance of the coated bevel does not look realistic at all even though the goal is to resemble real hard wood flooring.

Both the vacuum coating and roll coating are limited in terms of the "design" that can be placed on a surface that is to be coated. Such methods can be simply categorized as "pigment coating" as they relate more to coating a surface instead of providing a more complicated pattern, such as a "design" onto a surface.

Accordingly, there is a need to eliminate carrying an inventory of thermo-foils. There is also a need to provide short runs of printing and/or a higher speed of printing, with better images and performance. There is also a need to provide versatility in color and pattern selection to match the color and pattern of the surface décor or face design of the laminated flooring. There is also a need to provide a method of printing without limitations on a printed surface, in order to accommodate both a smooth surface and a rough surface. Thus, there is a need to print the surfaces of bevel edges as well as tongue and groove joints with the color and the pattern matching the décor surface of the laminate. Additionally, there is a need to provide better adhesion and abrasive resistance properties for decorating a bevel surface. There is an additional need to use an environmental friendly radiation curable, 4 processing color (CMYK) ink system to achieve desirable speed and property. There is a need to use an ink jet printing system with 4 printing heads to achieve flexibility and versatility in printing any color and any pattern. There is an additional need to align multiple printing heads in a straight line to maximize the printing quality and image of the design. There is also a need for mounting printing heads at a 45 degree angle (or other angle) facing upward to the transporting direction of the bevel edges of the panel. There is a need to print all bevel edges around the panel in line with the same or similar speed as the step of profiling the tongue and groove connecting joint. There is also a need to use piezo ink jet printing heads to optimize the droplet placement and size. There is a need to change meniscus/pressure regulation to control ink jet printing reliability. There is a need to set the throw distance of the printing heads at a safe gap to avoid head strikes by the moving panel. There is also a need for better material utilization and cutting down of the waste of materials. There is also a need for decorating a bevel surface with a minimum space required for printing and curing equipment. There is also a need for changing the color and the pattern of the bevel surface on the fly (without shutting down the line) during the operation. Flexibility in the manufacturing process and lowering of costs are also needed in a method and system for printing patterns and designs on bevel surfaces of laminated flooring.

SUMMARY OF THE INVENTION

A feature of the present invention is to eliminate the use of thermo-foils or to eliminate the need of having an inventory of various color designs for bevel surfaces and/or other surfaces.

Another feature of the present invention is to provide the ability to conduct short runs of printing in a method of printing patterns or designs on bevel surfaces and/or other surfaces.

An additional feature of the present invention is to provide better images in a method of printing patterns or designs on bevel surfaces as well as tongue and groove surfaces and/or other surfaces.

A further feature of the present invention is to provide higher speed printing in a method of printing patterns or designs on bevel surfaces as well as tongue and groove surfaces and/or other surfaces of laminated flooring.

Another feature of the present invention is to provide versatility in color and pattern selection to match the color and pattern of the surface décor or face design of the laminated flooring.

Other features of the present invention are to provide the ability to create a bevel design or other design on any type of surfaces, such as a smooth surface or a rough surface.

An additional feature of the present invention is to provide better adhesion and abrasive resistance properties of the bevel design on the bevel surface as well as tongue and groove surfaces and/or other surfaces.

An additional feature of the present invention is to print bevel surfaces and/or surfaces of the tongue and groove (and/or other surfaces) in one step without an additional step of applying a seal coat on the surfaces of the tongue and groove.

A further feature of the present invention is to use a radiation curable ink system instead of waxes for the surfaces of the tongue and groove as the seal coat.

An additional feature of the present invention is to mask the surfaces of the tongue and groove with radiation curable ink matching the décor design on the surface of the laminate flooring for realism of real hardwood flooring.

A further feature of the present invention is to use an ink jet printer and radiation curable ink to decorate the bevel surface and/or the tongue and groove surfaces and/or other surfaces.

An additional feature of the present invention is to provide the type of ink jet printer and the setup of the printing heads for printing the bevel design on the bevel surface and/or the tongue and groove surfaces and/or other surfaces.

Still a further feature of the present invention is to provide a method that reduces waste and requires lesser amounts of material to create bevel designs and/or other surfaces.

A further feature of the present invention is to provide a method that has flexibility with respect to printing patterns or designs on bevel surfaces and/or the tongue and groove surfaces and/or other surfaces of the laminated flooring.

Another feature of the present invention is to lower the production costs in printing patterns or designs on bevel surfaces as well as the tongue and groove surfaces of the laminated flooring.

Additional features and advantages of the present invention will be set forth, in part, in the description that follows, and, in part, will be apparent from the description, or may be learned by practice of the present invention. The objectives and other advantages of the present invention will be realized and attained by means of the elements and combinations particularly pointed out in the description and appended claims.

To achieve these and other advantages, and in accordance with the purposes of the present invention, as embodied and broadly described herein, the present invention, in part, relates to providing methods and systems for decorating a bevel surface and/or a tongue or groove surface and/or other surfaces of a laminated flooring by non-transfer printing. In the present invention, the method does not require the transfer of a pre-print onto a bevel surface. Preferably, the non-transfer printing is digital printing. In various embodiments, the methods and systems use ink jet printing technologies with inks (e.g., curable inks), such as radiation curable inks, to decorate the bevel surfaces and/or one or more surfaces of the tongue and groove of the laminated flooring, and/or other surfaces, such as recessed surfaces. The printing system can be installed in-line after profiling a tongue and groove and cutting the bevel edge on the laminated flooring. Alternatively, the printing system can be installed off-line as a stand alone operation after profiling a tongue and groove and cutting the bevel edge on the laminated flooring.

In an embodiment of the present invention, methods and systems for accurate, efficient, and flexible printing of decorative patterns or designs on bevel surfaces of laminated flooring are provided.

Additional features and advantages of the present invention will be set forth, in part, in the description that follows, and, in part, will be apparent from the description, or may be learned by practice of the present invention. The objectives and other advantages of the present invention will be realized and attained by means of the elements and combinations particularly pointed out in the description and appended claims.

All patents, applications, and publications mentioned throughout the application are incorporated in their entirety by reference herein and form a part of the present application.

The accompanying drawings, which are incorporated in and constitute a part of this application, illustrate some of the embodiments of the present invention and together with the description, serve to explain the principles of the present invention.

DETAILED DESCRIPTION OF THE PRESENT INVENTION

Figure 1:
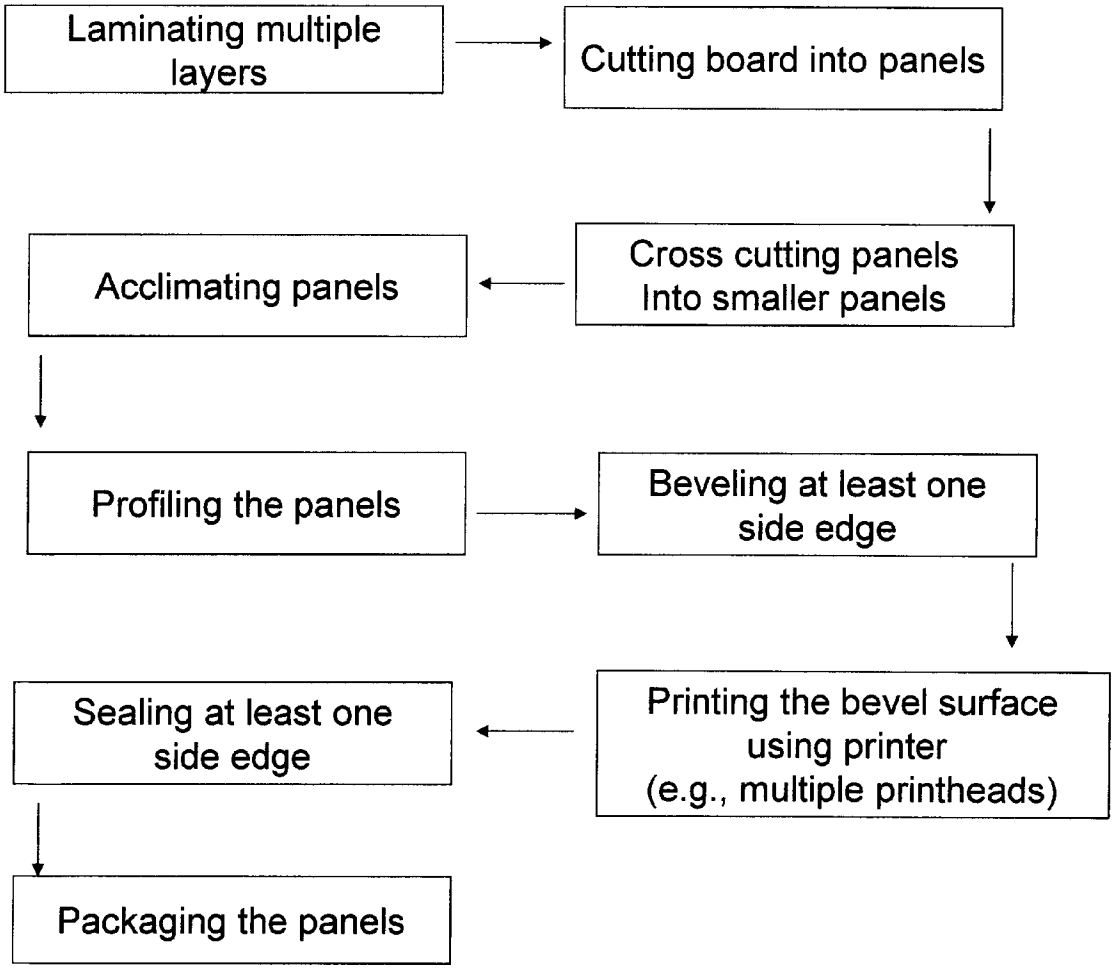
FIG. 1 is a process flow diagram of a method for printing a non-transfer decorative pattern on a bevel surface of a laminated flooring panel.

The present invention relates to methods and systems for decorating bevel surfaces (e.g., edges) and/or one or more other surfaces, such as surfaces of the tongue or groove present on laminated flooring. The present invention further relates to methods and systems of non-transfer printing, such as digital printing, on the bevel surfaces and/or one or more other surfaces, such as surfaces of the tongue and groove. According to various embodiments, the methods and systems can use ink jet (or laser printing) for printing on bevel surfaces and/or one or more other surfaces, such as surfaces of the tongue and/or groove that are present on laminated flooring, with colors and decorative patterns matching the décor patterns and face designs of laminated flooring.

The terms "face design," "décor pattern," and "print design" are used interchangeably herein when they relate to the top face or surface of the laminated flooring which comprises at least one design or pattern.

The terms "bevel," "bevel surface," and "bevel edge" are used interchangeably herein and are defined as the slanted or angled surface that forms part of a top surface on a plank, panel, or board for laminated flooring.

The term "surface" as used herein usually denotes one of the surfaces of a laminated flooring, such as the surface of a bevel when describing the printing or decorating process of the bevel surface.

The terms "image," "pattern," or "design" are used synonymously herein when referring to the printing of an image on the surface or substrate.

The term "non-transfer printing" refers to printing a design on a surface to provide a printed surface and does not involve the transfer of a pre-print or a layer or film that carries a print already made which contains a pattern or design onto the surface.

The terms "panels" and "planks" are used interchangeably herein.

The terms tongue and groove are conventional in laminated flooring and refer to the interconnecting joints that are part of laminated flooring and that permits two adjacent pieces to be joined together, either by mechanical locking profile designs or non-mechanical locking designs. With non-mechanical locking designs, adhesives can be used in the groove or tongue. The surfaces of the tongue and groove typically include an upper surface, lower surface and side surfaces. The upper surfaces face upward (in the tongue profile) and downward (in the groove profile) and are the surfaces closest to the walking surface or the décor layer of the laminated flooring.

The laminated flooring according to the present invention can have a substrate or core made of a variety of natural and/or synthetic materials, such as wood, polymeric, and the like. The core or substrate can be any conventional material used in laminate flooring, including, but not limited to, fiberboard (e.g., MDF, HDF), particle board, chip board, solid wood, veneers, engineered wood, thermoplastics, thermosets, oriented strand board (OSB), plywood, and the like. These laminated flooring substrates can comprise at least one core and at least one decorative pattern (the décor pattern or face design) on a top surface of the core. The decorative pattern serves as a decorative feature of the flooring. Any decorative pattern can be used such as, but not limited to, parquet, ceramic, stone, brick, marble, wood grain patterns, patterns with grout lines, other natural or unnatural surfaces, and the like. The decorative pattern can be printed on paper or on veneer; the paper can be coated or saturated with a resin(s) or a polymer(s), and then applied onto the top surface of the core. The top surface of the core can be textured by pressing the pattern layer onto the core, and a protective layer(s) can be created on top of the paper by a coating application(s). Heat and pressure can be used in this process. The protective layer can be called an overlay or the combined layer of resin, the protective layer, and the decorative pattern can be called an overlay pattern.

The laminated flooring according to the present invention can be made of a variety of materials as described above, have any construction, of any size or with any property known in the art of laminated flooring. For example, the laminated flooring can have a general construction comprising a four layer construction, although there is no limitation to the number of layers and the type of materials described herein. The four layer construction can have a highly abrasive resistance overlay that is clear, a décor layer or pattern (a pre-printed layer), a high density fiberboard (HDF) core, and a backer or balance layer. The core can be of a variety of materials, such as, but is not limited to, wood or plastic, chipboard, or HDF or medium density fiberboard (MDF). Other exemplary materials are described previously. All of the layers can have a paper component and can be treated with one or more resins, such as melamine or phenolic formaldehyde, or a urea formaldehyde solution, radiation pre-polymers such as epoxy acrylates, urethane acrylates, polyester acrylates, polyether acrylates or combinations thereof.

According to various embodiments, the paper which carries the decorative pattern can be any color, white, beige or others in roll or sheet form. It is preferred to use a non-white color paper for a darker decorative pattern because it alleviates an obvious white line at the interface of paper layers and core while the bevel edges are cut. The décor paper is placed by any method onto the core and a protective layer can be further applied on top of the paper. Wear resistant particles, such as $Al_2O_3$ can be in one or more of the coatings. As an option, the following is one way to form the laminate. With respect to the laminate on top of the core, a print layer is affixed to the top surface of the core, wherein the print layer has a top surface and a bottom surface. The print layer preferably is an aminoplast resin impregnated printed paper. Preferably, the print layer has a printed design. The printed design can be any design which is capable of being printed onto the print layer. The print layer is also known as a decor print layer. Generally, the print layer can be prepared by rotogravure printing techniques or other printing means such as digital printing. Once the paper has the design printed on it, the paper is then impregnated with an aminoplast resin or mixtures thereof. Preferably the aminoplast resin is a blend of urea formaldehyde and melamine formaldehyde. The print paper, also known as the decor paper, preferably should have the ability to have liquids penetrate the paper, such as a melamine liquid penetrating in about 3 to 4 seconds, and also maintains a wet strength and even fiber orientation to provide good reinforcement in all directions. The print paper does not need to be impregnated with the resin (this is optional), but instead can rely on slight resin migration from the adjoining layers during the lamination process (applying heat and/or pressure to laminate all layers to one). Preferably, the resin used for the impregnation is a mixture of urea formaldehyde and melamine formaldehyde resins. Urea formaldehyde can contribute to the cloudiness of the film that is formed and thus is not preferred for dark colors and the melamine resin imparts transparency, high hardness, scratch resistance, chemical resistance, and good formation, but may have high shrinkage values. Combining urea resins with melamine resins in a mixture or using a double impregnation (i.e., applying one resin after another sequentially) provides a positive interaction in controlling shrinkage and reducing cloudiness. Preferably, the type of paper used is 75 $g/m^2$ weight and having a thickness of 0.16 mm. The saturation of the coating preferably is about 64 $g/m^2$. Located optionally on the top surface of the print layer is an overlay. The overlay which can also be known as the wear layer is an overlay paper, which upon being affixed onto the print layer, is clear in appearance. The overlay paper is preferably a high abrasive overlay which preferably has aluminum oxide embedded in the surface of the paper. In addition, the paper can be impregnated with an aminoplast resin just as with the print layer. Various commercial grades of high abrasive overlays are preferably used such as those from Mead Specialty Paper with the product numbers TMO 361, 461 (70 gram/$m^2$ premium overlay from Mead), and 561 wherein these products have a range of Taber values of 4000 to 15000. The type of paper preferably used has a weight of about 46 $g/m^2$ and a thickness of about 0.13 mm. With respect to the print layer and the overlay, the amount of aminoplast resin is preferably from about 60 to about 140 $g/m^2$ and more preferably from about 100 to about 120 $g/m^2$. As an option, an underlay can be located and affixed between the bottom surface of the print layer and the top surface of the core. Preferably the underlay is present and is paper impregnated with an aminoplast resin as described above with respect to the print layer and overlay. Preferably, the underlay is Kraft paper impregnated with aminoplast resins or phenolics and more preferably phenolic formaldehyde resin or melamine formaldehyde resin which is present in an amount of from about 60 $g/m^2$ to about 145 $g/m^2$ and more preferably from about 100 $g/m^2$ to about 120 $g/m^2$ paper. The type of paper used is preferably about 145 $g/m^2$ and having a thickness of about 0.25 mm. The underlay is especially preferred when extra impact strength resistance is required. More than one layer of coating or layer of protection can be applied onto a top surface of the core and for a variety of purposes. Additional layers can be formed on the bottom of the core as well, such as a backing layer. A backing layer, for example, can be a melamine coated paper layer or any other desired material. Heat and/or pressure can be used to attach all layers including the decorative pattern onto the core. Other known applications in the art can be used to apply the decorative pattern onto a top surface of the core of the laminated flooring substrate.

The product size, i.e., of the final laminated flooring, can have any desirable size and number of bevels. For example, the product size can be 12 to 60 inches in length, 2 to 24 inches in width and ⅛ inch to ¾ inch in thickness, with one to four sided bevels. The bevels can have any bevel angle or bevel width. For example, the bevels can have a bevel angle from about 25 to about 60 degrees, and a bevel width of at least 0.5 mm. Preferably, the bevel angle is from about 40 to about 45 degrees, and/or the bevel width is from about 1.0 mm to about 3.0 mm or more, or from about 1.5 mm to about 2.0 mm.

The laminated flooring can have any type of shape and any type of bevel edge. For example, the laminated flooring can have a square shape or a rectangle shape. The bevel edge can have more than one angled surface. For example, part of the bevel edge can have an angle of 45 degrees while another part of the bevel edge can have an angle of 30 degrees. The bevel edge can be on one side or more than one side of the laminated flooring. The bevel edge can be continuous or discontinuous on one or more sides of the laminated flooring. For instance, the bevel edge can be a fraction of the side or can be interrupted by a non-bevel surface/edge on a side of the laminated flooring. The bevel surface can also have any shape and size (length or width). For example, the bevel surface can have a shape other than a perfect rectangle. The bevel surface can be rough (non-even or non-smooth) or smooth. An example of a rough surface can be seen when a particle board is cut and parts of the particles extend above the plane of the cut surface.

Another optional aspect of the core is the presence of a groove and/or a tongue profile on at least one side or at least two sides or edges of the core wherein the sides or edges are opposite to each other (or all sides or edges, e.g., four sides). For instance, the core design can have a tongue profile on one edge and a groove profile on the opposite edge. It is also possible for both edges which are opposite to each other to have a groove profile. The tongue or groove can have a variety of dimensions. The groove can be present on two opposite edges and/or can have an internal depth dimension of from about 5 mm to about 12 mm and a height of from about 3 mm to about 5 mm. The bottom width of the side having the groove can be slightly shorter than the upper width of the same side to ensure no gap exists between planks after butting together. With respect to the edges of the floor panels, which are joined together in some fashion, the floor panels can have straight edges or can have a tongue and groove design or there can be some intermediate connecting system used to join the floor panels together such as a spline or other connecting device. Again, any manner in which floor panels can be joined together is embodied by the present application. For purposes of the present invention, the floor panel can have a tongue and groove profile or similar connecting design on the side edges of the floor panel. Examples of floor panel designs, shapes, and the like that can be used herein include, but are not limited to, the floor panels described in U.S. Pat. Nos. 6,101,778; 6,023,907; 5,860,267; 6,006,486; 5,797,237; 5,348,778; 5,706,621; 6,094,882; 6,182,410; 6,205,639; 3,200,553; 1,764,331; 1,808,591; 2,004,193; 2,152,694; 2,852,815; 2,882,560; 3,623,288; 3,437,360; 3,731,445; 4,095,913; 4,471,012; 4,695,502; 4,807,416; 4,953,335; 5,283,102; 5,295,341; 5,437,934; 5,618,602; 5,694,730; 5,736,227; and 4,426,820 and U.S. Published Patent Application Nos. 20020031646 and 20010021431 and U.S. patent application Ser. No. 09/460,928, and all are incorporated in their entirety by reference herein.

In one embodiment, a floor panel can have at least two side edges wherein one side edge has a tongue design and the opposite side having a groove design, and wherein the tongue and groove are designed to have a mechanical locking system. These two edges are preferably the longer of the four side edges. The remaining two edges, preferably the short joints, can also have a mechanical locking system, such as the tongue and groove design, or the short joints can have a standard tongue and groove design, wherein one edge has a standard tongue design and the other edge has a standard groove design. The standard design is a design wherein the tongue and groove is not a mechanical locking system but is generally a tongue having a straight tongue design in the middle of the edge and the groove design has the counterpart groove to receive this tongue. Such a design has many advantages wherein a mechanical locking system can be used to connect the long sides of the plank, typically by tilting the tongue into the groove of a previously laid down plank. Then, the standard tongue and groove design on the short edges permits the connecting of the short edge of the plank to the previously laid plank without any tilting motion or lifting of the previous laid planks. The adhesive can be applied to all edges or just to the standard tongue and groove edges.

Thus, the present invention encompasses any type of joint or connecting system that adjoins edges of floor panels together in some fashion with the use of straight edges, grooves, channels, tongues, splines, and other connecting systems. Optionally, the planks can be joined together wherein at least a portion of the planks are joined together at least in part by an adhesive. An example of such a system is described in U.S. patent application Ser. No. 10/205,408, which is incorporated herein in its entirety.

The flooring products, design, and other configurations described in U.S. patent application Ser. No. 11/192,442 and/or U.S. patent application Ser. No. 10/697,532, as well as U.S. Pat. Nos. 6,986,934; 6,794,002; 6,761,008; and 6,617,009 can be used herein and are incorporated in their entirety by reference herein.

In one or more embodiments, curable inks can be used, such as radiation curable inks, for digitally printing the surface of bevels. The inks can be EB-curable or UV-curable inks, and can be ink-jetted or laser applied. The radiation curable inks can include a free radical and cationic system, and can contain ingredients which can initiate cross-linking reaction by ultraviolet light or electron beam. The advantages of this ink system are little to no VOC emission, not dried by heat, high curing speed, and excellent resistance and wear properties. The UV ink system can contain monomer(s), oligomer(s), photo-initiator(s), pigment(s) and additives, such as wetting agent(s) and dispersing aid(s) and stabilizer(s) and de-foaming agent(s), and the like. The first step in formulating UV curing inks can be to prepare a pigment paste by grinding pigments in a mill, such as an agitator ball mill. The pigments can be ground to very tiny particle sizes to flow through the printed head nozzles. The ideal pigment particle size is in the ranges between 50 nm-150 nm, with optionally a narrow particle size distribution. Then a portion of the pigment paste can be blended into a radiation curing resin system that contains resins, a photo-initiator, and additives according to the ink formula. The well-mixed fluids can be then fed into fine mesh of filters to remove large particle size of pigments that are agglomerated and flocculated together during the mixing operation.

For printing radiation curable inks on the surface of the bevel edges, there can be diffusion or capillary wicking into HDF or other cores taking place because of the high porosity of the material. This can be desirable in certain embodiments. The ink can be formulated to a higher viscosity to minimize diffusion. In addition, the printing speed can be fast and the dwell time of the inks staying on the surface can be short, about 0.25 second, which can freeze or stop the spreading of droplets. The less diffusion ink into the core can provide a higher image quality. On the contrary, the more ink diffused into the core can provide better adhesion and wear resistance. In one or more embodiments, the ink which is printed onto the bevel edge or a layer located on the bevel edge can have excellent adhesion and/or Taber abrasion. For instance, a foil film takes about 800 cycles to be totally removed from a surface, like a HDF surface. When a bevel edge design is printed on, such as by digital printing, for instance, inkjet printing, it takes over 2,400 cycles to remove the design from the bevel edge surface, such as a HDF surface. The bevel edge printed design or the tongue and/or groove printed design can have a Taber abrasion resistance of at least 1,000 cycles, such as from 1,000 cycles to 3,000 cycles, or from 1,500 cycles to 2,500 cycles, or from 2,000 cycles to 2,500 cycles. Also, the diffusion depth of the ink design on the bevel edge can be significantly greater than the design thickness achieved by transfer foil. For instance, the diffusion or penetration depth of the ink into the bevel edge can be 2 mils to 25 mils beneath the surface of the bevel edge (for instance, 5 mils to 20 mils or 10 mils to 15 mils and the like). This leads to the ability for the bevel edge to not show any design damage or other flaws when the bevel edge may be scratched or dented due to foot traffic or other reasons, like moving objects, or the mere handling of the plank during installation. Unlike the present invention, a transfer foil can have a thickness of only 1.1 mils, which is significantly thinner. Multiple printheads (e.g., 2 to 4 or more) are generally sufficient to cover small bevel edge areas and achieve high print density. There is no lack of fill or mottle appearance. The fluids are typically heated up to a desired viscosity inside printheads to achieve the optimal jetting performance.

The process flow or manufacturing process of the laminated flooring can have any steps conventional in the art in addition to the printing methods according to the present invention. FIG. 1, for example, shows the manufacturing of the beveled laminated flooring that can comprise at least one of the following steps (and can be in the following order): a) using a presser for pressing or laminating multiple layers of material together, b) using at least one rip saw for cutting a large size board (which can be, for example, 81.5 inches, by 103 inches) into panels (or planks), c) using at least one cross saw for cutting the panels into smaller panels, d) using a device for acclimating the panels by storing them in a controlled environment, e) using a device for profiling the panels to form at least one tongue and/or at least one groove, f) using a device for beveling at least one side edge of the panel, g) using a device for sealing at least one side edge (which can include the bevel surface and/or the tongue and groove), and/or h) using a device for packaging the panels.

The printer that is used for printing on the bevel surface according to the present invention can be installed on-line with the profiling machines and the packaging machine. The location of printing the bevel surface preferably takes place after step f) and before step g). Alternatively, the printer that is used can be installed off-line as stand alone operations from the manufacturing process that can print the bevel surface after edges of panels are cut.

The steps of making the laminated flooring can comprise some of these steps or additional steps. Thus, various embodiments of making laminated flooring according to the present invention comprise at least a printing step added after the step of forming the bevel. The bevel surface can also be modified before or after the printing step. For instance, the bevel surface can be treated in a variety of ways to alter the surface characteristics of the bevel surface. For example, the bevel surface can be treated so that the surface roughness is altered. The surface roughness of the bevel surface can be reduced in order to have a low surface roughness and thereby create a smoother surface. Also, or alternatively, the bevel surface can be treated or modified such that the porosity of the bevel surface is altered. For instance, the porosity can be reduced so that the bevel surface has a lower porosity or is substantially non-porous. Also, or alternatively, the bevel surface can be modified or treated so that the bevel surface is hardened. Also, or alternatively, the bevel surface can be modified or treated so that the bevel surface provides consistent gloss and visual image after printing. For instance, the bevel surface can be modified or treated so that the surface hardness of the bevel surface is increased. In addition, or alternatively, the bevel surface can be modified or treated so that the surface is altered to provide a surface that is more receptible to a printed image from a printer. The modification or treatment of the bevel surface can be achieved in many ways. For instance, the bevel surface can be heat-treated or plasma-treated to alter the surface tension to enhance the quality of printing and bonding. Such ways include a heated roller, hot iron, infrared, plasma jet, corona or other devices. The bevel surface can be treated with one or more materials, such as coatings. For instance, the materials or coatings can be at least one polymeric coating, surfactant coating, coating containing at least one pigment or dye, wax, and the like. The coating can be curable, such as by UV or EB curable, and preferably the coating is a surface that can receive a permanent ink image. The coatings can be multiple coatings, such as two or more coatings. The coatings can be the same or different from each other. When coatings are applied prior to the printing of the decorative pattern, the coating(s) can be dried or cured prior to the printing of the decorative pattern or the coating can remain wet or remain semi-wet (e.g., partially cured or tacky). The semi-wet or tacky state of the coating can have the ability to increase adhesion of the subsequently printed decorative pattern. Furthermore, the use of a semi-wet or tacky coating can be cured at the same time as the curing of the printed decorative pattern, especially when the printed decorative pattern is printed from radiation-curable inks. The bevel surface can also be sealed or coated for any reasons and by any methods known in the art. For example, the bevel surface can be coated by a material that facilitates the printing process or by a material that provides protection to the surface. Exemplary materials are wax and primer. The sealing process can be before or after the printing step, as desired. Optionally, a device can be used to provide a texture on the bevel surface. Any device or method known in the art can be used. For example, an embossing roll can be used to provide the texture. The texture can be formed on the bevel surface before or after the printing step. Any post-printing treatment can also or alternatively be used in the present invention. For instance, any treatment, such as coating, such as a clear coating, wear layer, protective layer, and/or top coating can be used to further protect or alter the gloss of the printed image on the bevel surface. These coatings can be UV curable. The coatings can be similar to the coatings used in resilient vinyl flooring and the like. The optional coating(s) that can be applied after printing of the decorative pattern can be cured at the same time as the ink is cured from the decorative pattern or it can be separately cured in a separate curing or drying step.

Figure 2:
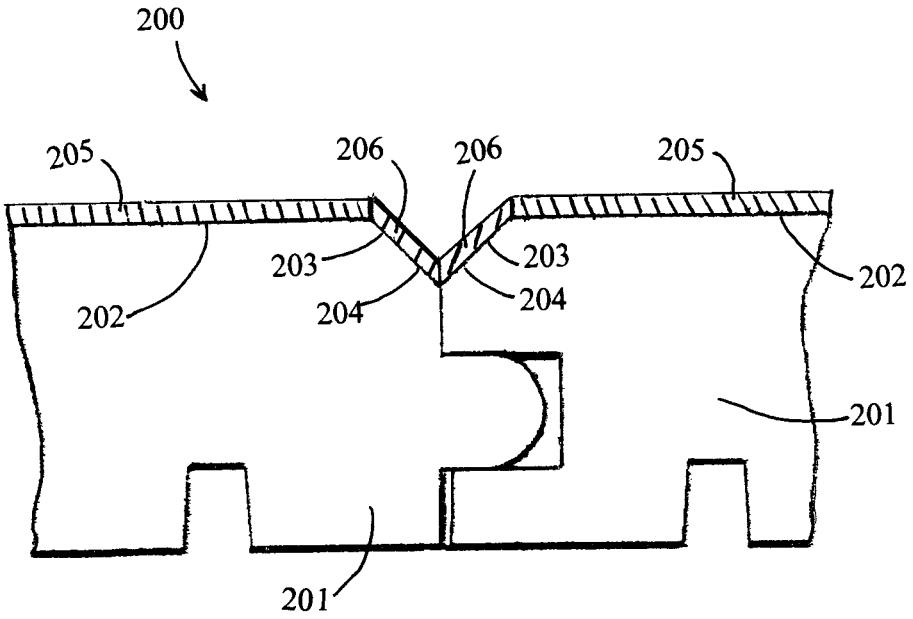
FIG. 2 is a cross section view of a laminated flooring panel having at least one bevel surface having a non-transfer printed decorative pattern printed thereon.

It is to be understood that the laminated flooring according to the present invention is not limited to any of the specific features described above, and that the process of making the laminated flooring according to the present invention is not limited to any step known as conventional, but only requires that the laminated flooring, or the substrate that ultimately becomes a laminated flooring, has a bevel surface. FIG. 2, for example, shows a laminated flooring panel 200 which has a core 201 having a top surface 202, a bevel 203 having a bevel surface 204, a pre-printed décor pattern 205 or face design on the top surface or as a layer on the core, except on the bevel surface, and a non-transfer printed decorative pattern 206 on the bevel surface 204 or a layer on the bevel surface.

The printing on the bevel surface of the laminated flooring according to the present invention can provide a design or decoration ranging from simplistic to highly complex. In order to accomplish this, the present invention utilizes non-transfer printing that does not require the transfer of a pre-print or a layer or film that carries a print already made which contains a pattern or a design. The non-transfer printing can be digital printing.

Different technologies of digital printers include, but are not limited to, laser, electrophotography, magnetography, ionography, inkjet including continuous and drop on demand printing system, thermography, including transfer and sublimation type, electrographic (electrostatic), digital stencil duplicators, image setters and place setters, direct imaging conventional presses, and combinations thereof. These types of digital printers can be used to produce high quality images. More preferably, the digital printer is an ink jet printer.

Inkjet printers deposit multi-colored ink onto a substrate. Dye sublimation printers use heat, applied to a multi-colored ribbon or film, to release a dye that is transferred onto a substrate. The printers can produce high resolution, photo-like images that are suitable for printing high quality and complex images. The printers can have multiple printer settings to control the format, print resolution, and/or print quality. In addition, the printers can come with printer-specific device driver software that converts the stored image pixel data in the computer into the actual printer output to be printed. The laser printer has similar commonalities.

A type of ink jet technology that can be used for printing the surface of a bevel for the laminated flooring according to the present invention, is piezoelectric continuous ink jet (CIJ) or piezoelectric drop-on-demand (DOD), or pulse printing. The DOD printing process is controlled by turning on and off an electrical voltage that is applied to piezoelectric crystals. When the voltage is applied, the crystals deflect inward and squeeze out a droplet of ink from the nozzles; once the voltage is turned off; the crystals relax back and hold the ink in the nozzles.

The printing that is used according to the present invention can be adopted in many printing, patterning and related processes for at least three principle reasons. First, it is a direct method to accurately place a material such as a design, onto a surface in one step. Second, it is a digital process which enables creating designs by way of programs, software, data, and the like, and continuously changing the output without the need of any intermediate stages. And third, it provides a non-contact method of depositing inks to provide a printing design. Therefore, this method of printing is not limited as compared to the conventional transfer printing on bevel surfaces. Additionally, the inks that can be used in printing are very versatile because they can comprise a water base, a solvent base, and/or a UV curable base material.

With the present invention, the color and pattern of the bevel surfaces can easily match the color and pattern of the main surface (top face) of the laminated flooring, which can be a design using printed paper, as previously described. The resolution of the printed image/design on the bevel surface can therefore, be varied or constant as desired. The resolution can be any desired resolution. For example, the resolution can be from about 100 dpi to about 2,600 dpi (dot per inch). Preferably, the resolution is from about 100 to about 600 dpi or 200 dpi to 400 dpi. For example, the design printed on the bevel surface, can be, but is not limited to, a color and wood grain pattern (or other pattern) having an image resolution of at least 300 dpi.

According to various embodiments, generating color and pattern in the digital printing using printing comprises maneuvering the density deposition of usually four principle colors, such as cyan, magenta, yellow, and black (CMYK), by use of a software program. Optionally, the printer used according to various embodiments, produces four color process images, with these four colors, by use of inks, such as radiation curable inks. The number of colors, however, can be more than four, such as eight or more, with light shades of colors and/or spot colors such as white. Optionally, each color has several dedicated printheads and each of the printheads can contain multiple numbers of nozzles per head, preferably a minimum of 256 nozzles per head.

A number of methods can be used to generate a design for the print image that is ultimately placed on the surface of the bevel, such as using any software programs or devices available in the market (such as using a digital camera to take a picture) to generate digitized images or scanning a sample or desired image, such as the surface décor (face design) of the laminated flooring, with any software programs or devices available in the market (such as a scanner). The print image that is ultimately placed on the bevel surface can be derived from a scanned, sample image of the surface décor (face design) of the laminated flooring. The appropriate software known in the art can then be used to process images, separate colors and reproduce the images for further modifying and/or developing the desired color and pattern of a digital image file that matches the scanned samples. For example, once a picture is taken or an image is scanned (or an image can even be independently generated), it can be unmodified or modified so that the pattern dimensions matches and/or lines up with the dimensions of the bevel surface, and be aligned adjacent to the pattern on the edge of the surface décor or face pattern of the laminated flooring. Such software can also allow color and/or pattern modifications. Therefore, the appropriate software along with the appropriate printing technology can provide versatility in color and pattern selection to match the color and pattern of the surface décor (face design) of the laminated flooring in a method of printing patterns or designs on bevel surfaces of laminated floorings.

As an option, a surface or the entire surface of the tongue and/or groove profile, if present, on the laminated flooring panel can be printed with the same decorative pattern as described above. The printing of the decorative pattern on the surface of the tongue and/or groove profile can be the entire surface, or a portion thereof. The printing of the decorative pattern on at least a portion of the tongue and/or groove profile has numerous benefits. For instance, the decorative pattern can be printed on the upper surface of the tongue or lower surface of the groove (wherein the surfaces face upwards towards the walking surface of the panel and can be visible when a panel is not totally or fully connected to an adjacent panel). By printing a decorative pattern on the surfaces, the surfaces are less visible to the observer walking on the floor, especially when the panels are connected, and thus do not show the unsightly core of the laminate flooring. Also, the printing of the surface of the tongue profile or groove profile provides a protective benefit in that the printing of the decorative pattern on the tongue and/or groove profile serves as a protective layer on the tongue or groove profile. This protective layer acts as a sealant thereby protecting the tongue profile and/or groove profile from moisture, damage, and the like. This protective benefit is especially apparent when radiation curable inks are used. For purposes of the present invention, the decorative pattern on the tongue and/or groove profile can be the same or different from the decorative pattern on the bevel edge and can be a single color or can be a pattern printed from ink, such as radiation-curable ink. Preferably, the parts of the tongue profile and/or groove profile, which are visible to an observer walking on the surface, are preferably printed with the decorative pattern using ink, such as radiation-curable ink and using the process of the present invention. The entire edge of the laminated flooring panel, including all surfaces of the tongue and all surfaces of the groove, can be printed on with the ink to form a decorative pattern, as described herein.

The printheads (e.g., two, three, or four) can be mounted to a single master plate with precision print-head alignments. The number of printheads can be one, two, three, four, five, six, or more. Each printhead can print a single color, such as cyan, magenta, yellow, or black. The master plate can be controlled by a servo motor for moving up and down and angle rotation. All printheads can be moved together simultaneously with a single adjustment and maintain the same alignment to each other and also the same distance to the bevel edges of panels. The selection of image resolution in dpi of the printhead can be controlled by a single rotation point. The configuration of the printheads to the moving direction of the panel is set at any desired angle, such as a 45 degree angle, facing upward or downward to the bevel edge; the direction of the printheads depends upon the orientation of the bevel edges with the decorative surface of the laminate planks. The throw distance between printheads to the bevel edges of the panel can be from 0.1-10 mm distance. Preferably, the throw distance between the printheads to the bevel edges of the panel is 0.5-6 mm. The most ideal throw distance is 1-3 mm, which provides an excellent print quality and also a safety margin for the printheads to not strike a moving panel. In order to jet inks (or print inks) upward at an angle, like a 45 degree angle, the Meniscus pressure and the tolerance need to be modified as compared to the typical down jetting position. The Meniscus pressure is from −5.2 mbar negative pressures (vacuum) to −0.1 negative pressures for delivering ink upward. The meniscus tolerance is also tighter from +/−2.0 mbar to +/−0.5 mbar. It is preferred to accurately place ink reservoirs at a fixed position for Meniscus control. Therefore, the ink reservoirs for each color printhead can also be mounted on the single master plate. During maintenance cycles, purging inks in the printheads should be done. The printheads set at an angle, e.g., 45 degree angle, facing upward to the bevel edges is not the most idea position to purge inks. Therefore, the printed heads can be rotated downward by a small servo motor and the Meniscus pressure can be regulated from negative to positive pressure during rotation prior to purging inks out of the printheads. Purging downward is a more reliable process and avoids any potential damage to expensive nozzle plates.

The printing method and printing device according to the present invention is therefore very flexible and versatile. The printing method and printing device allows change of the printing design "on the fly." For instance, with the present invention, it is very easy to change the print design or other attributes of the print design without shutting down the overall manufacturing process. More particularly, and strictly as an example, limited runs of particular print designs on bevel surfaces can be achieved with the present invention. The present invention can do this with essentially no delay in the manufacturing process. In other words, the print design can change from one panel to the next or for any limited number of panels simply by instructing the printing heads to alter the design to the next design. Thus, any number of panels can receive a particular bevel edge print design, such as 100 panels, and then the next print design can be changed in a matter of 1 second to seconds to print the next chosen design and so on. Thus, limited runs of particular floor panels can be obtained without stopping the entire manufacturing process. With current, conventional technology, the manufacturing process must be stopped in order to replace the foils with the next design and similar problems occur with other printing or coating techniques. With the present invention, it is extremely easy to alter the print design to any different design or alter the characteristic of the print design based on a particular quantity and/or quality of the print on the bevel surface. Thus, the present invention relates to the formation of a bevel edge print which can be changed on the fly without interruption of the printing and/or without interruption of the manufacturing process overall. There is no need for re-tooling the printing device, which is required in gravure printing or thermo-foil printing, or in an emboss by registration process. For example, the design, the resolution (dpi), the speed of printing, and/or the width of printing can be changed while printing on the bevel surface.

The printing method according to the present invention can be computer controlled and/or automated. Appropriate software can be used to manipulate the image or the image resolution, as previously described. Any image processing software available in the art can be used, such as Adobe® software, Microsoft® software, Canon® software, Xerox® software, Kodak® software, and the like. One or more software can be used to control and/or manipulate the printing design and/or the printing process. In order to control and automate the printing process, appropriate devices can be used, such as, but not limited to, processors, monitors, sensors, and the like. For instance, a sensor, such as a photo eye, can be used to detect the laminated flooring or its bevel surface and determine the start of the printing process. Therefore, it is preferable that at least one of the devices is in communication with another device to control the printing process. For instance, the photo eye can detect the bevel surface and send a signal to the processor. The process can display a signal on the monitor indicating that the bevel surface has been detected. The processor can also provide instructions for the printer to start the printing process. Preferably, the processor (or controller) provides data to at least one part of the printer. For example, the printer can have one, two, three, four or more printheads, such as inkjet printheads. The processor or controller can obtain variable data (such as data from the photo eye, etc.) and convert it into digital information. The digital information, such as timing information, can then be used to control the printheads. The processor or controller can therefore, provide instructions to each of the printheads. Optionally, the processor or controller can also obtain feedback information from each printhead.

Preferably, the processor or controller can control the printer and other equipment associated with the printer and/or the manufacturing process of the laminated flooring, simultaneously. Functions of the processor or controller can be controlled by a user interface, such as a WINDOWS® based touch screen interface. The user interface can allow real time monitoring of print systems (such as printheads and/or ink delivery systems), sensors (such as photo eyes), and/or encoders (encodes information). The processor or controller can be monitored and controlled remotely. Preferably, the processor or controller can perform at least one of the following functions: a) print job preparation and set-up, b) variable data input or manipulation, c) image processing, d) inkjet or laser system set-up and monitoring (printhead setup and status; ink delivery system set-up and status), e) line inputs (encoders; photo eyes/triggers; line speeds), and f) system monitoring files (uptime; fault generation log files and statistics; full system diagnostics).

Another benefit of the printing method according to the present invention is that the amount of ink needed to cover a surface such as that of the bevel is properly utilized and not wasted. Digital printing using, for instance, ink jet or laser technology, is highly accurate in placing the ink onto the desired surface. Since the printing method can be computer controlled, the amount of ink and the individual steps of printing can also be controlled. The result is a more precise and efficient printing method. This is in contrast with wasted materials in other processes such as thermo-foil transfer printing.

Another benefit of using the present invention for providing the desired designs is overcoming the problem of poor adhesion on a roughened surface of the bevels, which is seen in using thermo-foil, as previously described. Digital printing is a non-contact process that practically directly deposits inks onto the bevel surface. The inks can be absorbed and penetrated into core materials, even those having rough surfaces, such as HDF and therefore achieve excellent adhesion.

Additionally, because of the small surface area of the bevels, and many of the benefits of using printing as described above, the printing of the bevel surfaces can run at high speeds. The print speed can be changed to correspond to the complexity of the design. The print speed can be automated and controlled by the computer or appropriate software, as previously described. The print speed, therefore, can be constant or varied. The print speed can be from about 10 to about 500 feet per minute, and therefore the manufacturing line speed can be the same. Preferably, the print speed is from about 100 to about 400 feet per minute. For example, the print speed can be targeted at least 200 feet per minute, at least 300 feet per minute, at least 400 feet (100 meters) per minute (e.g., 100 feet per minute to 500 feet per minute) for a bevel having any bevel angle, such as 40-45 degrees, and for example, a bevel width of 1.5-2.0 mm, and therefore a print surface coverage of 2.2 square feet per minute (132 square feet per hour). Again, the production line speed can be the same. The desirable printing speed is determined by the required resolution. The higher the resolution of the printed image required, the slower the print speed used. For instance, Jetrion 3010 can easily run 400 ft/min speed for a 200 dpi resolution quality, and generally is slower for a 600 dpi quality of printed image.

Optionally, piezoelectric DOD ink jet technology can be used because of the drop control, fluid flexibility and good reliability that is associated with this type of hardware. Optionally, the piezoelectric DOD ink jet printheads can be manufactured by XAAR®, United Kingdom, or JETRION® or SPECTRA®, United States. For example, the JETRION® 3010 Printing System for CMYK process color, available from Jetrion, L.L.C., can be used. However, other types of printheads can be used. For example, types known as "fixed heads," "disposable heads," or "3-D versatile heads" can be used. Optionally, the DOD ink jet technology is used according to various embodiments of the present invention.

For example, an ink jet printer can be configured to be in communication with a sensor that detects the arrival of a plank and triggers a signal to the ink jet head to send droplets of ink onto the surface of the bevel. If the plank is transported on a transporting device to the printer, appropriate devices such as hardware and/or software can be configured to adjust parameters, such as the speed and direction of the planks. Alternatively, the plank can be stationary and the printer or other devices are in motion instead. The printer and other devices can, therefore, be configured to provide adjustable speed and direction of printing. Other appropriate hardware, such as a computer, digital cameras, and the like, along with the appropriate software, such as known manipulation software, can be used to obtain the requisite information and control the ink supply and the function of the printing head mounts, as well as the overall printing process. For example, the set-up of the printing apparatus according to the present invention can be configured with the appropriate or desirable printheads and ink selection. For both the DOD and CIJ ink jet technologies or other print systems, the number of sets of ink jet can be configured individually for each or all of the four bevels that can exist on a laminated flooring plank. Each set of ink jet can have at least CMYK color heads. The printing apparatus can be configured for in-line or off-line printing. Due to the mobility and adaptability of the printing apparatus according to the present invention, the printing apparatus can also be configured for feasibility and reliability testing before it is actually placed in the in-line or off-line manufacturing process. For example, the following parameters can be tested and determined: color and pattern matching, adhesion/abrasion, quality of image, speed (printing and curing), extended jetting test for color consistency, jet-ability over a large volume of ink, and the like. Therefore, due to the versatility of the printing process or printing apparatus according to the present invention, modifications to the printing process and printing apparatus can be made easily and efficiently.

A printed image can be sent through a radiation curing chamber to solidify the ink. Therefore, according to various embodiments, the laminated flooring with the ink associated with the printed image on the bevel surface is solidified by curing, such as UV or EB curing.

Optionally, before and/or after printing, other steps can be taken such as surface texturing and/or sealing of the bevel surface, as previously described. For example, when a surface texture on the bevel surface is also formed, as a further option according to this embodiment, an embosser roll can be used to texturize the bevel surface after the ink is cured, such as by the UV light. For instance, the embosser roll can roll on the bevel surface and uses pressure to create indentations on the bevel surface. The indentations can have a pattern, such as the pattern of wood grain. Other methods of texturizing can be used, such as using an embossing roll, as previously described. Alternatively, texture can be provided on the bevel surface before printing the bevel surface.

Resolution of the printed image can be excellent. However, it depends on a number of factors such as the drop size of the ink, the drop reproducibility, the drop spread on the substrate, the process used to place the drops of ink, and the number of drops per inch limitation. Optionally, at least one of these factors can be controlled in order to print the bevel surface for the laminated flooring according to the present invention.

For example, the size of the single droplet of ink can be controlled to be about 25-50 microns. The printed image or design can be formed by thousands of these droplets with a given amount of each of the colored ink, such as the four colored ink previously described. The droplets can be placed on top of existing droplets with an offset to smooth out the edges in order to create the color and pattern for a sharp image, such as in image resolution of at least 300 dpi. Optionally, the resolution can be from about 300 to about 2,600 dpi. Preferably, the resolution can be from about 300 to about 600 dpi.

Optionally, the print quality should be such that there is complete coverage on the bevel surface so that there are no overprinting, no print defects such as streaks, voids (misprints), color variation, and the like.

The ink used to print can be any ink known in the technology, such as, but not limited to, aqueous ink, non-aqueous ink, solvent ink, dye sublimation ink, curable ink, such as UV curable type ink, and the like. Aqueous ink can be a mixture of water, glycol and one or more dyes and/or pigments. For non-aqueous inks, the ink can be a non-aqueous solvent system with one or more dyes and/or pigments. UV-curable inks can comprise mainly of acrylic monomers with a photo-initiator package and at least one dye and/or pigment. As described herein, this ink can be cured by UV-light after printing. An advantage of these inks is that they dry instantly, and can print on a wide range of coated or uncoated substrates. Sublimation dyes can be used as well.

Preferably, the ink used is a UV-curable ink. Optionally, the ink used is a 100% UV curable type since the advantages of using this ink can be speed (such as the high throughput rates), safety (such as not requiring the use of a dry oven), environmental friendly (such as emitting little or no volatile organic component (VOC)), sharp image, and/or excellent adhesion or wear (abrasive) resistance properties. The printed image, pattern or design on the surface or substrate can be created by the ink jet heads and can then be rapidly irradiated by ultraviolet (UV) light. This affects the in situ free radical or cationic polymerization resulting in enhanced solidification of the ink.

Optionally, the ink properties can have at least the properties of fast curing speed, good adhesion to a core, such as a HDF board core or surface thereof, abrasion resistance which is equal to or better than a thermo-foil print, and/or UV curable with at least the colors of cyan, magenta, yellow, and black.

By using an innovative ink jet printing technology with a UV curable ink system (or other ink system) according to various embodiments, a visually pleasing decoration or pattern can be produced on the bevel surfaces of laminated flooring. The printing process according to various embodiments can be implemented in an upstream process or a downstream process. The printing system as described can be installed in-line after (or before or during) profiling a tongue and groove and cutting the bevels of the laminated flooring. Alternatively, the printing system can be installed off-line as a stand alone operation after (or before or during) profiling a tongue and groove and cutting the bevels of the laminated flooring. In other words, steps in the manufacturing of laminate flooring can be performed before or after the step of ink printing on the bevel surface according to various embodiments. The versatility of the printing system can provide a change of the design of the print "on the fly." Re-tooling of the printer is not necessary. Changes in the design, speed, and/or resolution of the print can be made while printing. As a result, manufacturing, quality, and/or visual image requirement for a bevel print can be provided according to the embodiments of the present invention.

The present invention can, in addition, or alternatively, be useful for surfaces other than bevel surfaces. For instance, a decorative pattern can be formed by the non-transfer printing system of the present application on a variety of recessed surfaces or large embossed areas or surfaces having angles or other shapes. As specific non-limiting examples, the recessed surfaces or embossed areas can include or simulate borders, grout areas, mortar areas, and/or other depressed or indented areas. Just as the present invention provides significant benefits to creating decorative patterns on bevel surfaces, the present invention can provide similar benefits to other surfaces, such as recessed surfaces or large embossed areas. For instance, the present invention can involve the non-transfer printing of an ink onto a recessed surface, such as an area simulating a border, grout, or mortar area or other depressed or indented areas of a flooring panel, such as a laminated flooring panel. The recessed surface can be linear, non-linear (e.g., wavy, curves, etc.). The recessed surface can have conventional widths, lengths, and depths which simulate mortar areas, grout areas, border areas, and the like. The recessed surfaces that can receive the non-transfer printing of an ink to form a decorative pattern can be at the edge of the flooring panel, near the edge, and/or away from the edge, such as in the middle of the decorative area of the panel. These areas can be anywhere on the panel. The recessed area(s) can exists in combination with the bevel edge embodiment of the present invention described earlier, or can be without a bevel edge embodiment.

In one or more embodiments, a recessed surface, such as an area simulating a border, grout, or mortar is created or can be created by embossing a portion of the flooring panel, or removing a portion of the top surface of the flooring panel, or other means to create the appropriate shape and texture, including depth and shape of a border area, mortar area, grout area, or other depressed or indented area. By doing so, the use of a pre-printed décor pattern or face design on the top surface of the overall flooring panel will not work or, as in the case of creating a bevel edge, simply the pre-printed décor pattern or face design must be removed in order to achieve the simulation of the border area, mortar area, grout area, or other depressed or indented area. However, in order to achieve an overall flooring panel that simulates a natural flooring product, such as a wood panel, stone, brick, tile, or ceramic design, the areas simulating the grout, mortar, or borders must receive a decorative pattern in order to conceal the area of the pre-printed décor pattern or face design that was removed. Generally, as explained earlier, transfer printing, such as thermo-foil, is not applicable for decorating grout, mortar, and border areas of a plank/tile which have recessed areas, especially away from the edge, and the recessed depth can be relatively shallow in relationship with non-recessed areas and, therefore, it is difficult to transfer the printing thermo-foil into the recessed areas with enough pressure for good adhesion and also to control the foil precisely going into the recess areas without transferring it onto the boundary of the flat, non-recessed surface of the panel. Through the present invention and the use of non-transfer printing of an ink, such as using the techniques described above with respect to the bevel edge embodiment, the present invention provides the ability to have a controlled printing of a decorative pattern into a precise area so that the decorative pattern is in register with recessed surfaces. Also, by non-transfer printing from a distance, the recessed area can be smooth or rough and still receive a print design. Furthermore, rough surfaces, which can be created by routing the top surface of the panel or core, such as particle board, can easily simulate mortar or grout lines with respect to texture and then can be easily printed with the design of grout or mortar or other recessed areas using the present invention which can have non-contact printing with the recessed area and, therefore, the surface of the print area does not need to be smooth.

With the present invention, the areas of the recessed surfaces can first receive a non-transfer printing or the recessed areas can be embossed first or a portion of the surface of the flooring panel can be removed to create the recessed surface, which then can receive a non-transfer printing to create a decorative pattern.

The non-transfer printing can be digital printing. The non-transfer printing can comprise printing with a printing system comprising at least four printheads aligned in a straight line and mounted with the printheads facing upward to the recessed surface, which can be facing upside down, though this is not a requirement. The printing can occur facing downward with the recessed surface facing right-side up. The printheads can be mounted on a single master plate controlled by a server motor, as explained above, wherein the printheads are capable of being moved together simultaneously and the printheads are capable of rotating downward to face downward to purge ink if this embodiment is used. Ink reservoirs for each printhead can be located on a single master plate. The printheads can have an ink throw distance of from 0.1 to 10 mm, though other throw distances are possible. The printheads can have an ink throw distance, for instance, of from 0.5-3 mm. The ink can be a radiation-curable ink or other type of ink. The method of making the laminated flooring pattern having at least one recessed surface can further include curing the ink once the non-transfer printing has occurred to form the decorative pattern. The ink printing from the printheads can have a meniscus pressure of −5.2 mbar to −0.1 mbar and a meniscus tolerance of +/−2.0 mbar to +/−0.5 mbar. As stated, the digital printing can comprise inkjet printing.

In one or more embodiments, the laminated flooring panel can have a pre-printed décor pattern or face design on a top surface of the laminated flooring pattern, except on the recessed surface(s), and the decorative pattern formed by the non-transfer printing matches and lines up (e.g., in register) with the pre-printed design of the laminated flooring in order to create an overall final decorative design. The decorative pattern can simulate parquet, ceramic, tile, stone, brick, wood, marble, other natural surfaces, or any combination thereof. As stated, the non-transfer printing that forms a decorative pattern can simulate the mortar, grout, or borders of various simulated surfaces, such as the borders, grout, or mortar seen with parquet, ceramic, tile, stone, brick, marble, or other natural surfaces. The decorative pattern can simulate a wood grain pattern.

In one or more embodiments, the recessed surface can comprise fiberboard material, such as high density fiberboard or medium density fiberboard. The ink can be an ultraviolet light-curable ink or an electron beam-curable ink. The decorative pattern that is printed on the recessed surfaces can have an image resolution of at least 300 dpi. The printing can comprise at least four color process images. In the present invention, in one or more embodiments, the laminated flooring can have a print design on the top surface, except on the recessed surface, and one method of the present invention can further comprise obtaining a digital picture of or a scanned image of the print design and then modifying the digital picture or scanned image to have dimensions of the recessed surface.

In one or more embodiments of the present invention, the present invention relates to a laminated flooring panel comprising a core having a top surface; one or more recessed surfaces; a pre-printed décor pattern or face design on the top surface or as a layer on the core, except on the one or more recessed surfaces, and a non-transferred printed decorative pattern on the one or more recessed surfaces or on a layer on said recessed surfaces. The laminated flooring pattern, in this embodiment, can have a non-transfer printed decorative pattern having an image resolution of at least 300 dpi. The non-transfer printed decorative pattern can comprise radiation cured ink, and the non-transfer printed decorative pattern can have a Taber abrasion resistance of at least 1,500 cycles, and the non-transfer printed decorative pattern can have an ink diffusion depth of from 2 mils to 25 mils or other ink diffusion depth. The laminated flooring pattern can have a pre-printed décor pattern or face design having a pattern adjacent to the recessed areas and the decorative pattern can have a pattern where the pattern matches and/or lines up with the pattern of the non-transfer printed decorative pattern. The construction of the laminated flooring panel, with or without a bevel edge, can have the same construction as described earlier with respect to the bevel edge embodiment. The laminated flooring pattern can optionally have a tongue profile or a groove profile on one or more sides of the laminated flooring panel.

As with the bevel edge embodiment, the present invention further relates to a system for making a laminated flooring pattern having at least one recessed surface, comprising at least one non-transfer digital printer configured to print a decorative pattern on the at least one recessed surface of the laminated flooring pattern. The non-transfer digital printer can comprise four printheads aligned in a straight line and mounted facing upward or downward. The printheads can be mounted on a single master plate controlled by a Servo motor, wherein all printheads can be moved simultaneously and the printheads can be rotated downward. The system can include an ink reservoir for each printhead initially mounted on the single master plate. The ink reservoir can contain radiation-curable ink. The non-transfer digital printer can comprise an inkjet printer. A digital camera or scanner or other device that takes pictures of or scans an image of the print design can be used, and a device can be used that modifies the picture or scanned image so that the picture or scanned image matches and/or lines up with the recessed surface. The system can also include a device that sensed the recessed surface in order to control the start of printing, such as the use of a photo eye. The non-transfer digital printer can be stationary and the laminated flooring panel can move along the non-transfer digital printer. The printer can be configured to print at least at a speed of 100 meters per minute and/or print a print surface coverage of at least 2.2 square feet per minute. The system can include a device to provide surface texture on the recessed surface before or after the decorative pattern is printed on the recessed surface. The recessed surface can be treated prior to the non-transfer printing, which can include applying at least one coating on the recessed surface prior to the non-transfer printing of the ink. The various coatings and other surface treatments can be the same as described above with respect to the bevel edge embodiment.

As stated, all embodiments relating to the bevel edge embodiment can be applied to this recessed surfaces embodiment as well, and each of those variations and options and descriptions apply equally to this embodiment and are incorporated herein by reference.

Applicants specifically incorporate the entire contents of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A method of making a laminated flooring panel having at least one bevel surface, comprising non-transfer printing an ink onto the bevel surface to form a decorative pattern.

2. The method of claim 1, wherein the non-transfer printing is digital printing.

3. The method of claim 2, wherein the digital printing comprises ink jet printing.

4. The method of claim 1, wherein said non-transfer printing comprises printing with a printing system comprising at least four printheads aligned in a straight line and mounted at an angle of from 30 to 60 degrees with said printheads facing upward to said bevel surface, which is facing upside down.

5. The method of claim 4, wherein said printheads are mounted on a single master plate controlled by a servo motor, wherein said printheads are capable of being moved together simultaneously and said printheads are capable of rotating downward to face downward to purge ink.

6. The method of claim 5, wherein ink reservoirs for each printhead is located on said single master plate.

7. The method of claim 4, wherein said printheads have an ink throw distance of from 0.1 to 10 mm.

8. The method of claim 4, wherein said printheads have an ink throw distance of from 1-3 mm.

9. The method of claim 4, wherein said ink printing from said printheads has a meniscus pressure of −5.2 mbar to −0.1 mbar and has a meniscus tolerance of +/−2.0 mbar to +/−0.5 mbar.

10. The method of claim 1, wherein said bevel edge is surface treated prior to said non-transfer printing.

11. The method of claim 10, wherein said surface treating comprises applying at least one coating on said bevel surface prior to said non-transfer printing said ink, wherein said non-transfer printing is on said at least one coating.

12. The laminated flooring panel of claim 1, further comprising at least one coating located between said bevel surface and said non-transfer decorative pattern.

13. The method of claim 1, wherein said ink is a radiation curable ink, and said method further comprises curing said ink.

14. The method of claim 1, wherein said laminated flooring plank has at least one tongue or groove, and said method further comprises non-transfer printing said ink onto a surface of said tongue or said groove or both.

15. The method of claim 14, wherein said non-transfer printing of said tongue or said groove occurs at surfaces of said tongue or said groove that face upward.

16. The method of claim 1, wherein said non-transfer printing occurs at a print speed of at least 100 feet per minute, wherein said printing is upward and at an angle.

17. The method of claim 1, wherein said laminated flooring panel has a pre-printed décor pattern or face design on a top surface of said laminated flooring panel except on said bevel surface and the decorative pattern matches and lines up with the said pre-printed design of the laminated flooring.

18. The method of claim 1, wherein the decorative pattern simulates parquet, ceramic, stone, brick, marble, a wood grain pattern, a natural surface, or any combination thereof.

19. The method of claim 18, wherein the decorative pattern is a wood grain pattern.

20. The method of claim 1, wherein the bevel surface comprises high density fiberboard or medium density fiberboard.

21. The method of claim 1, further comprising the following steps:

a) pressing or laminating multiple layers of material together,
b) rip cutting a large size board into panels,
c) cross cutting the panels into smaller panels,
d) acclimating the panels by storing them in a controlled environment,
e) profiling the panels to form at least one tongue and/or at least one groove, and
f) beveling at least one side edge of the panels.

22. The method of claim 21, wherein the printing is performed on-line or in the same line of manufacture of at least one of steps a) to f).

23. The method of claim 1, wherein said ink is an ultraviolet light-curable ink.

24. The method of claim 1, wherein said ink is an electron beam-curable ink.

25. The method of claim 1, wherein the decorative pattern that is printed on the bevel surface has an image resolution of at least 300 dpi.

26. The method of claim 1, wherein the printing comprises at least four color process images.

27. The method of claim 1, wherein said laminated flooring panel has a print design on a top surface except on said bevel surface, and said method further comprising obtaining a digital picture of or scanned image of said print design, and modifying the digital picture or scanned image to have dimensions of said bevel surface.

28. A method of making a laminated flooring panel having at least one recessed surface, comprising non-transfer printing an ink onto the recessed surface to form a decorative pattern.

29. The method of claim 28, wherein said recessed surface simulates mortar, grout, or a border.

30. The method of claim 29, wherein said recessed surface is located away from an edge of said laminated flooring panel.

31. The method of claim 28, wherein the non-transfer printing is digital printing.

32. The method of claim 31, wherein the digital printing comprises ink jet printing.

33. The method of claim 28, wherein said non-transfer printing comprises printing with a printing system comprising at least four printheads aligned in a straight line and mounted with said printheads facing upward to said recessed surface, which is facing upside down.

34. The method of claim 33, wherein said printheads are mounted on a single master plate controlled by a servo motor, wherein said printheads are capable of being moved together simultaneously and said printheads are capable of rotating downward to face downward to purge ink.

35. The method of claim 34, wherein ink reservoirs for each printhead is located on said single master plate.

36. The method of claim 33, wherein said printheads have an ink throw distance of from 0.1 to 10 mm.

37. The method of claim 33, wherein said printheads have an ink throw distance of from 1-3 mm.

38. The method of claim 28, wherein said ink is a radiation curable ink, and said method further comprises curing said ink.

39. The method of claim 38, wherein said ink printing from said printheads has a meniscus pressure of −5.2 mbar to −0.1 mbar and has a meniscus tolerance of +/−2.0 mbar to +/−0.5 mbar.

40. The method of claim 28, wherein said laminated flooring panel has a pre-printed décor pattern or face design on a top surface of said laminated flooring panel except on said recessed surface and the decorative pattern matches and lines up with the said pre-printed design of the laminated flooring.

41. The method of claim 28, wherein the decorative pattern simulates parquet, ceramic, stone, brick, marble, a natural surface, or any combination thereof.

42. The method of claim 28, wherein the decorative pattern is a wood grain pattern.

43. The method of claim 28, wherein the recessed surface comprises high density fiberboard or medium density fiberboard.

44. The method of claim 28, wherein said ink is an ultraviolet light-curable ink.

45. The method of claim 28, wherein said ink is an electron beam-curable ink.

46. The method of claim 28, wherein the decorative pattern that is printed on the recessed surface has an image resolution of at least 300 dpi.

47. The method of claim 28, wherein the printing comprises at least four color process images.

48. The method of claim 28, wherein said laminated flooring panel has a print design on a top surface except on said recessed surface, and said method further comprising obtaining a digital picture of or a scanned image of said print design, and modifying the digital picture or scanned image to have dimensions of said recessed surface.

49. The method of claim 28, further comprising surface treating said recessed surface prior to said non-transfer printing.

50. The method of claim 49, wherein said surface treating comprises applying at least one coating on said recessed surface prior to said non-transfer printing said ink, wherein said non-transfer printing is on said at least one coating.

* * * * *